US006164389A

United States Patent [19]

Fanuel et al.

[11] Patent Number: 6,164,389

[45] Date of Patent: Dec. 26, 2000

[54] CORE SAMPLING METHOD AND CORE SAMPLER THEREFOR

[75] Inventors: Philippe Fanuel, Brussels, Belgium; Rune Holt, Trondheim, Norway; Cor Kenter, Leiden, Netherlands; Marco Brignoli, Brugherio, Italy

[73] Assignee: Dresser Industries, Inc., Dallas, Tex.

[21] Appl. No.: 09/101,483

[22] PCT Filed: Jan. 15, 1997

[86] PCT No.: PCT/BE97/00005

§ 371 Date: Nov. 19, 1998

§ 102(e) Date: Nov. 19, 1998

[87] PCT Pub. No.: WO97/26439

PCT Pub. Date: Jul. 24, 1997

[30] Foreign Application Priority Data

Jan. 15, 1996 [BE] Belgium ..... 09600033

[51] Int. Cl.[7] ..... E21B 25/06

[52] U.S. Cl. ..... 175/20; 175/58

[58] Field of Search ..... 175/20, 58, 226, 175/236, 246

[56] References Cited

U.S. PATENT DOCUMENTS

| | | |
|---|---|---|
| 2,147,896 | 2/1939 | Harrington . |
| 2,633,336 | 3/1953 | Stokes . |
| 2,713,473 | 7/1955 | Talbot . |
| 3,207,240 | 9/1965 | Hugel . |
| 3,548,958 | 12/1970 | Blackwell . |
| 3,818,997 | 6/1974 | Bridwell . |
| 4,479,557 | 10/1984 | Park et al. . |
| 5,360,074 | 11/1994 | Collee et al. . |

*Primary Examiner*—William Neuder
*Attorney, Agent, or Firm*—Browning Bushman

[57] ABSTRACT

A core sampling method, particularly for the oil industry, wherein actual core sampling is performed by means of a core sampler (1) comprising at least one Inner barrel (5), an outer barrel (2) and a bit (3), and a substantially axial compressive force (F) is exerted on the top (7A) of a core sample (7) being formed, at least during a major part of the core sampling process, said force being within a range determined particularly on the basis of the material of the core sample (7), whereafter the force (F) is removed at the latest before the core sample (7) is withdrawn from the inner barrel (5). A core sampler for carrying out the method is also provided.

13 Claims, 5 Drawing Sheets

CORE SAMPLING METHOD AND CORE SAMPLER THEREFOR

The present invention relates to a core-sampling method, particularly for the oil industry, comprising core sampling proper using a core sampler comprising at least an inner barrel, an outer barrel and a bit.

It has become apparent that during core sampling and/or during a certain period of time after this operation, some formations to be sampled tend to lose a fairly sizeable proportion of their original properties, particularly their mechanical properties. For example, their cohesion may be altered to a greater or lesser extent. This being the case, it may even happen that part of the core sample is completely destroyed during core sampling. At least some of the information it was hoped to obtain through the operation is therefore lost. In other cases, the formations may tend to disassociate into separate superposed layers, which then present the appearance of a stack of plates, and such core samples do not reflect the true situation and do not have the true parameters of the formation which it is desired to analyze.

The object of the present invention is to solve this problem and to provide a core-sampling method which enables the core sample obtained from these formations to retain properties which are as close as possible to those of the formations in the state which they were in prior to core sampling.

To this end, the core-sampling method of the invention comprises:

during at least most of the core-sampling, applying, to the top of a core sample being formed, a substantially axial compression force that is within limits chosen as a function, in particular, of the material of the core sample, and eliminating this force, at the latest before the core sample is removed from the inner barrel.

The solution proposed by the present invention to this problem has come as a surprise to those skilled in the art who tend to exert the least possible stress on a core sample while it is being produced, out of fear of damaging it. Numerous and very expensive laboratory trials carried out on formations of diverse natures have been needed in order to establish that the method of the invention solves the aforementioned problem.

According to one embodiment of the invention, the compression force is produced by:

installing, in the inner barrel, a piston, one face of which is brought up against the top of the core sample, introducing into the inner barrel, on the opposite side of the piston to the face pressing on the top of the core sample, a fluid which, at least during core sampling, is brought up to a pressure corresponding to the compression force, accumulating energy resulting from the pressure of the fluid, and when said fluid pressure decreases, restoring the accumulated energy, in the form of the compression force being maintained, at least temporarily, on the top of the core sample.

The present invention also relates to a core sampler designed for implementing the method of the invention, and comprising:

an outer barrel, a coring bit borne by one end of the outer barrel, known as the front end when considering the direction of progress of the core sampler during core sampling, so as to rotate the bit, an inner barrel, housed in the outer barrel and having an internal space for accommodating a core sample, a piston arranged in the internal space in order to slide therein and so as to be able to press against the bottom of a sampling hole and on the top of the core sample which is formed and which penetrates the inner barrel, and means of introducing a fluid into the internal space between the piston and a closed end of the inner barrel, situated at the rear end thereof.

According to the invention, the above core sampler further comprises:

elastically compressible means, arranged in connection with the internal space so that they can accumulate and restore energy resulting from the pressurizing of the fluid introduced, at least following compression of this fluid by the piston driven into the internal space by the core sample, and means of adjusting a leak of the fluid introduced, which means are arranged in such a way that the fluid introduced into the internal space can escape therefrom as the core sample pushes the piston into it, and so that depending on the leak adjusted, the pressure of the fluid introduced into the internal space increases up to a value that corresponds to a substantially axial compression force applied by the piston to the top of the core sample and which is between limits chosen as a function of the material of the core sample.

According to one embodiment of the invention:

the elastically compressible means comprise, on the opposite side of the piston to the core sample, an auxiliary piston arranged to slide in the internal space and a compressible elastic element, preferably a spring arranged between the piston and the auxiliary piston, and the auxiliary piston has, on the opposite side to the piston, a face which is intended to receive the aforementioned pressure and which is dimensioned to provide at least some of the aforementioned force, the additional part of this force if need be then originating from a face of the piston, which face is directed toward the closed end of the inner barrel.

Other details and specific features of the invention will emerge from the secondary claims and from the description of the drawings which are appended to this text and which illustrate the core-sampling method and the core sampler of the invention, by way of nonlimiting examples.

Figure 1:
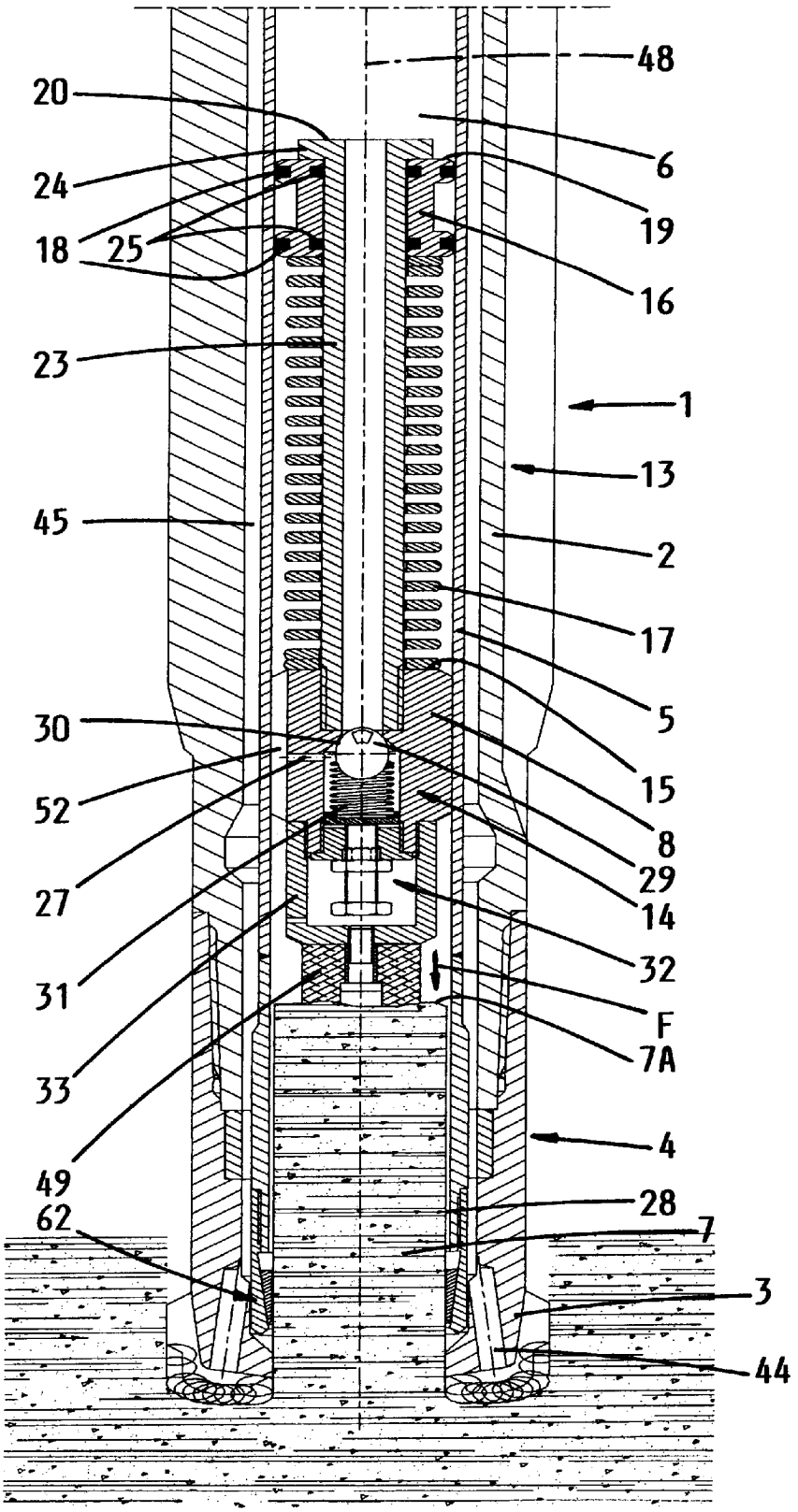
FIG. 1 depicts diagrammatically, in longitudinal section, with cutaway, a front end of a core sampler, according to one embodiment of the invention, during core sampling.

In the various figures, the same reference notation denotes elements which are identical or analogous.

The core sampler 1 according to the invention, and illustrated by way of example in the drawings, is intended for core sampling, for example in the field of prospecting for oil or natural gas.

The core sampler 1 may comprise (FIGS. 1, 2 and 4):

an outer barrel 2 made up, for example, of several lengths screwed together end to end, a coring bit 3 borne by the front end 4 of the outer barrel 2, so as to rotate the bit 3, an inner barrel 5, for example also made up of several lengths fixed together end to end, housed in a known fashion inside the outer barrel 2 and having an internal space 6 for accommodating a core sample 7 during a sampling operation.

a piston 8 arranged, with or without seals, in the internal space 6 in order to slide therein and so as to be able to be guided by the wall of the inner barrel 5 and so as to bear against the bottom of a sampling hole (not depicted) at the instant that sampling begins and then, during sampling, on the top 7A of the core sample 7 which forms and which enters the inner barrel 5, and means 9 of introducing a fluid into the internal space 6 between the piston 8 and a closed end 10 of the inner barrel 5, which end lies at the rear end of this barrel when considering the direction of progress of the core sampler 1 during sampling.

According to the invention, the aforementioned core sampler 1 further comprises elastically compressible means 13, arranged in connection with the internal space 6 so as to be able to accumulate and restore energy resulting from the pressurizing of the fluid introduced. This pressurizing may result from at least one compression of this fluid by the action of the pistons 8 driven into the internal space 6 as the core sample 7 enters it. These means 13 could consist, for example, of a chamber (not depicted) filled with a compressible gas.

According to the invention, the core sampler 1 also comprises means 14 of adjusting a leak of the fluid introduced. These adjusting means 14 are arranged in such a way that the fluid introduced into the internal space 6 can escape therefrom as the core sample 7 pushes the piston 8 into it and so that depending on the leak adjusted, for example by an orifice of small cross section, the pressure of the fluid introduced into the internal space 6 increases up to a value that corresponds to a substantially axial compression force F applied by the piston 8 to the top 7A of the core sample 7, this force F being between limits chosen, in particular, as a function of the material of the core sample 7.

Rather than the aforementioned compressible-fluid chamber, the elastically compressible means 13 preferably comprise, on the opposite side 15 of the piston 8 to the core sample 7 (during sampling), an auxiliary piston 16 and (between the latter and the piston 8) , a compressible elastic element 17 which is advantageously a compression spring 17. The auxiliary piston 16 is designed to slide in the internal space 6 and preferably has at least one annular seal 18 to seal it against the wall of the inner barrel 5. One face 19 of the auxiliary piston 16, which face is directed toward the closed end 10, is intended to receive the aforementioned pressure and is dimensioned to produce at least some of the force F applied to the top 7A of the core sample 7. If necessary, the additional part of the force F may come from a face 20 of the piston 8, which face is directed toward the closed end 10 of the inner barrel 5.

Figure 4:
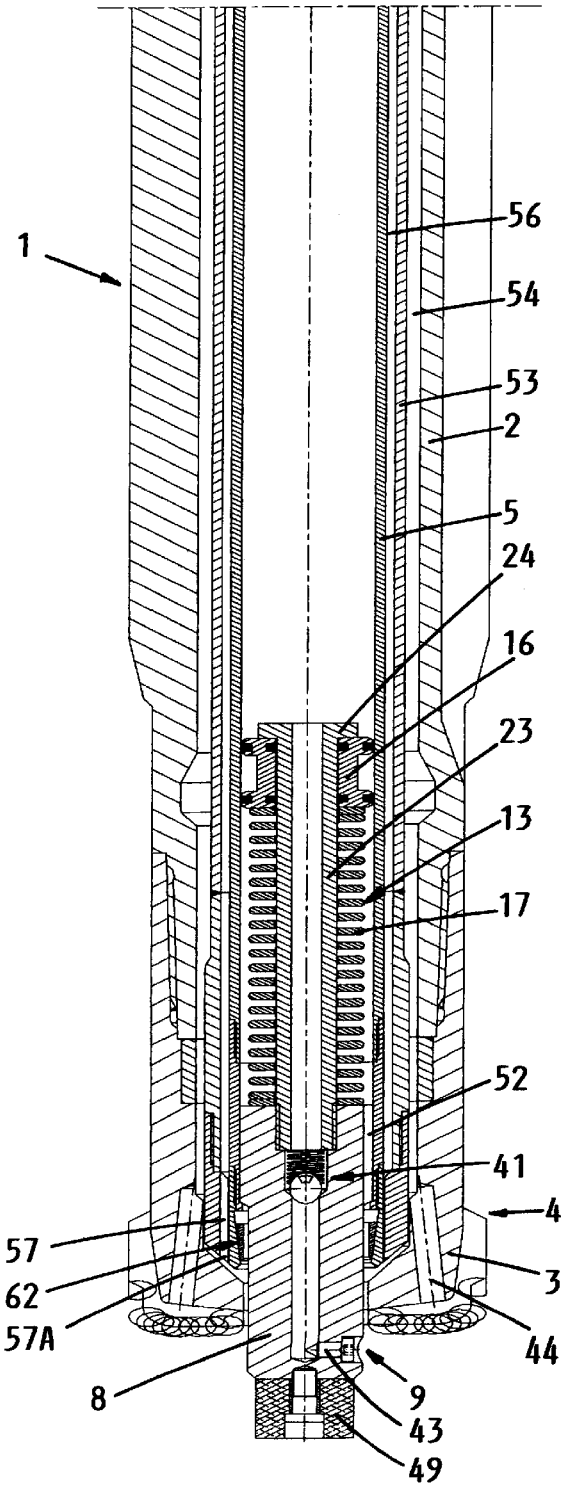
FIG. 4 depicts diagrammatically, in longitudinal section, with cutaway, a front end of another embodiment of the invention, in a position ready for core sampling.

The piston 8 may comprise, on the same side as the closed end 10, a rod 23 coaxial with the inner barrel 5 and the auxiliary piston 16 may have an annular shape and be mounted so that it slides along the coaxial rod 23. This rod may comprise stop means 24 situated away from the piston 8 and determining an extreme position of the auxiliary piston 16 away from the piston 8. At least one annular seal 25 may be arranged between the auxiliary piston 16 and the coaxial rod 23 to prevent fluid from escaping from the internal space 6 in an uncontrolled fashion. The spring 17 may be mounted around the coaxial rod 23 as shown in FIGS. 1, 2 and 4.

The piston 8 may comprise the means 14 of adjusting the leak and channels 27 associated with these means and designed to place the internal space 6 in fluid communication with the top 7A of the core sample and, from there, with an annular gap 28 between the core sample 7 being formed (FIG. 1) and the inner barrel 5 via these leak-adjustment means 14.

The leak-adjustment means 14 of FIG. 1 comprise a ball 29 pressed against a valve seat 30 by a compression spring 31, and the force that this spring exerts on the ball 29 can be adjusted by a screw and nut assembly 32, so as to obtain a desired pressure in the internal space 6 before a leak of fluid takes place, and therefore a desired compression force on the top 7A. A cap 33 protects the adjustment assembly 32.

Figure 2:
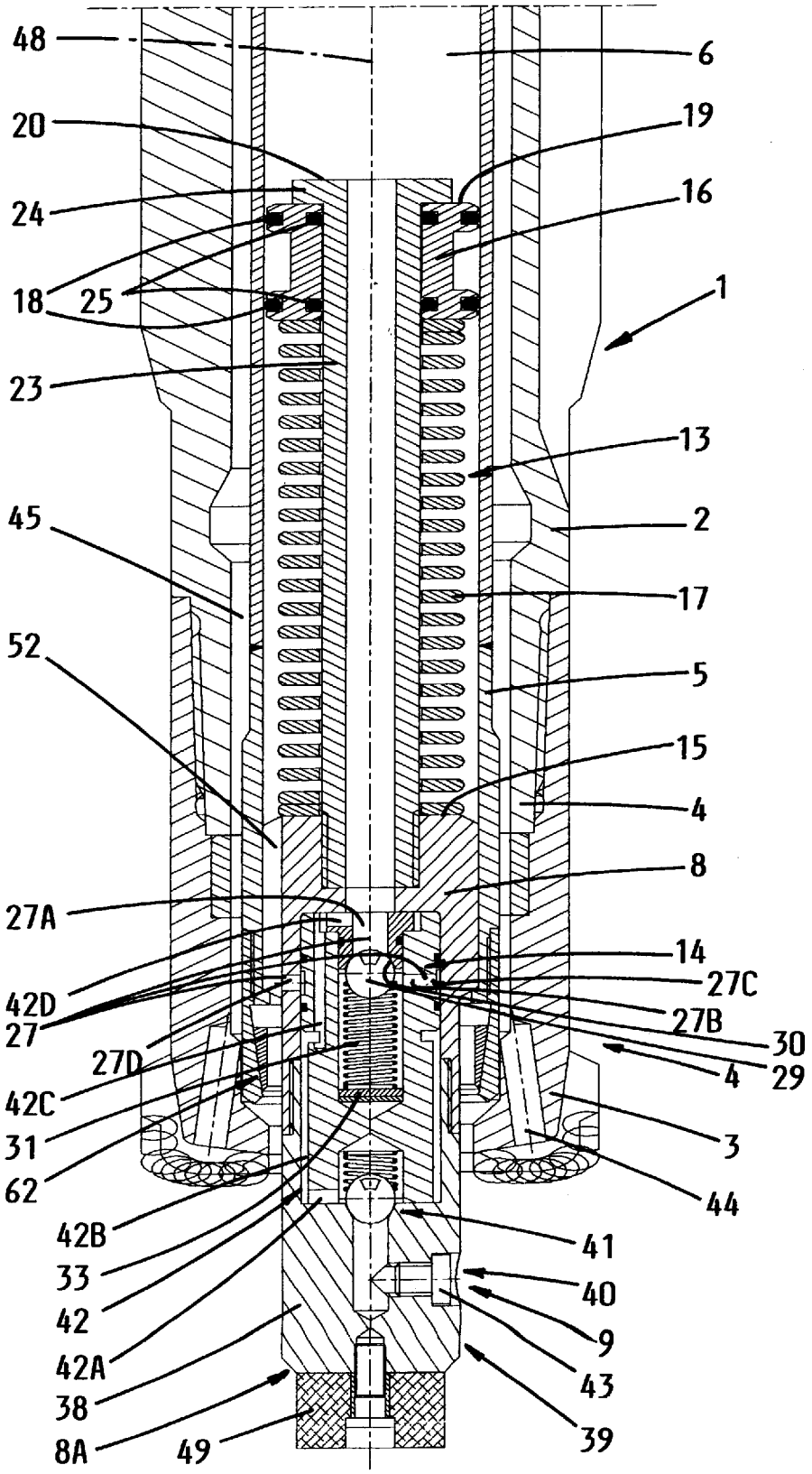
FIG. 2 depicts diagrammatically, in longitudinal section, with cutaway, a front end of another embodiment of the core sampler of the invention, in a position ready for core sampling.

The leak-adjustment means 14 of FIG. 2 comprise a spring 31 which is calibrated or adjustable using shims 34. Furthermore, the channels 27 are made up of an axial duct 27A upstream of the ball 29 with respect to the direction in which the fluid departs when the ball 29 opens and, downstream of this ball, of one or more radial ducts 27B opening into an annular duct 27C which is connected to one or more radial ducts 27D opening outside of the piston 8. A person skilled in the art will understand the construction of the components in FIGS. 1 et seq. and the way in which they can be mounted in order to obtain the desired result. It is therefore unnecessary to give further details on this subject.

The piston 8 may be produced in such a way that in its position at the beginning of sampling (FIG. 2), it has a portion 38 which protrudes beyond the bit 3. This portion 38 comprises the front end 39 of the piston 8 which end is intended to interact with the top 7A of the core sample. At this point on this end 39, there may be provided in the piston 8, for the means of introducing the fluid into the interior space 6, a filling port 40 equipped, for example, with a ball and with a nonreturn spring 41 [sic], a duct 42 connected to the filling port 40 and passing through the piston 8 in the form of a radial duct 42A, an annular duct 42B, one or more longitudinal ducts 42C and one or more radial ducts 42D opening, for example, into the axial duct 27A and, through the rod 23, into the internal space 6. A screw 43 may be used to plug the filling port 40 so as to protect it. A radial position (FIG. 2) of this port 40 is favored, for example, because then a filling means (not depicted) used for injecting a fluid into at least part of the internal space 6, screwed onto the port 40 does not tend to make the piston 8 rotate in the internal space during this screwing.

The fluid introduced into the internal space 6 (FIGS. 1 to 3) prior to a core-sampling operation may be different than the fluid which may be sent during sampling, from the reservoir on the surface (not depicted), through the conventional nozzles 44 in the bit 3 via a longitudinal annular pipe 45 formed between the inner barrel 5 [lacuna] the outer barrel 2. The fluid thus injected into the internal space 6 may be chosen, for example, for its properties of protecting and/or lubricating the core sample 7 being produced and penetrating this internal space 6.

Figure 3:
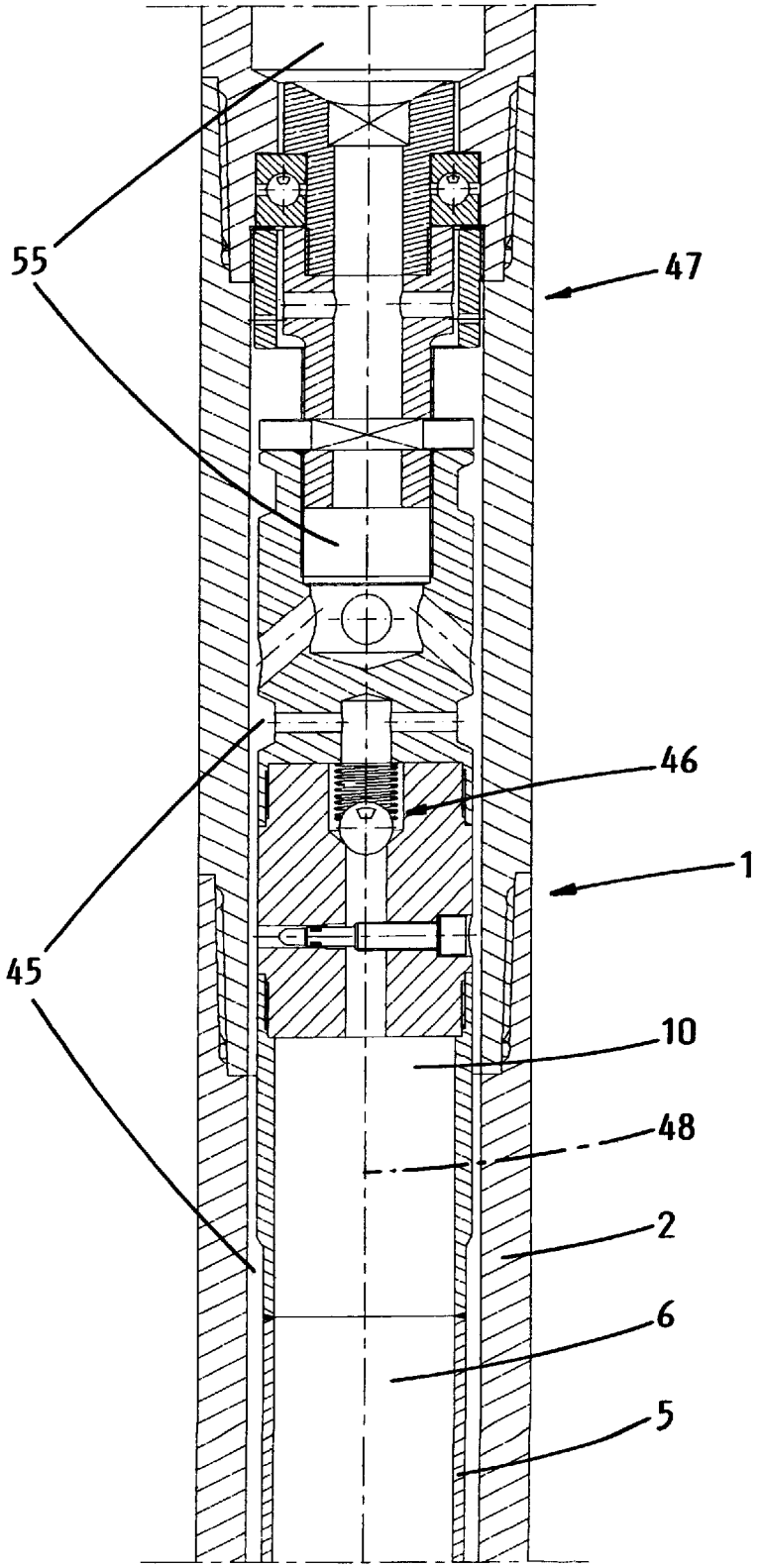
FIG. 3 depicts diagrammatically, in longitudinal section, with cutaway, the core sampler of FIG. 1 or 2 at the point where the inner and outer barrels are connected.

The core sampler 1 of the invention may also comprise (FIG. 3) on the same side as the closed end 10 of the inner barrel 5 or of the internal space 6, a safety valve 46 designed, for example, to open in order to bleed out the air lying in the internal space 6 at the time of filling thereof, or in order to limit to a chosen maximum, the pressure in this space during filling or during sampling, or also after this. The embodiment of FIG. 3 is such that during filling, only the force of a valve spring keeps this valve against its seat whereas during core sampling, the pressure of the sampling fluid sent by the longitudinal pipe 46 adds, by its action on the valve 46, a substantial force to the spring force. When the safety valve 46 is opened, it places the internal space 6 in communication with a space or pipe 45 between the outer barrel 2 and inner barrel 5.

FIG. 3 also shows connecting means 47 designed so that the inner barrel 5 is borne coaxially by the outer barrel 2 and can turn independently thereof about their common longitudinal axis 48. The connecting means 47 are also designed to guide toward the longitudinal pipe 45 the sampling fluid that comes from the reservoir on the surface.

The core-sampling method of the invention can be explained now with the aid of the core sampler 1 of the invention which comprises at least the inner barrel 5, the outer barrel 2 and the bit 3. In its most general mode, the method of the invention further comprises, during at least most of the core-sampling operation, applying a substantially axial compression force F to the top 7A of the core sample being formed. This compression force F is between limits chosen particularly as a function of the material of the core sample 7. This compression force F is eliminated preferably after core sampling has been completed and at the latest just before removing the core sample 7 from the inner barrel 5.

In the case of the core sampler 1 described hereinabove, the compression force F is produced by installing in the internal space 6 of the inner barrel 5, the piston 8, one face 8A of which may be pressed against the top 7A of the core sample 7, preferably by means of an element 49, for example an elastic element, which absorbs unevenness of the surface of the top 7A. There is then introduced into the inner barrel 5, on the opposite side of the piston 8 to its face 8A that rests against the top 7A, for example using introduction means 9, a fluid which is brought, at least during sampling, to a pressure that corresponds to the compression force F. Energy from the pressure of the fluid in the internal space 6 is accumulated, for example by the partial compression of the spring 17. When this fluid pressure tends to decrease, during core sampling, the spring restores the accumulated energy, in the form of the compression force F being maintained, at least temporarily, on the top 7A of the core sample 7.

As a preference, at the beginning of core sampling, the fluid thus introduced into the internal space 6 is practically at the pressure of the medium surrounding the bit 3 (outside of the sampling hole and in it). As the core sample 7 enters the inner barrel 5, it pushes the piston 8 therein and this piston therefore compresses the fluid to a pressure within a chosen range of pressures determined, for example, by a calibrated leak of fluid through the leak-adjusting means 14.

The fact that (FIG. 2) the end 39 of the piston 8 protrudes from the front end 4 gives the piston 8 some initial travel for compressing the fluid in the internal space 6 and thus for producing a force F (which can be chosen) applied, right from the start of core sampling, to the top 7A of the core sample 7.

According to the embodiment of FIG. 1, the fluid compressed in the internal space 6 acts on the face 19 of the auxiliary piston 16 and causes the latter to slide along the rod 23 and thus compresses the spring 17 in order to store up energy and at the same time push the piston 8 against the core sample 7. The pressure of the fluid may also act on part of the face 20 of the rod 23 so as to assist with pushing the piston 8 against the core sample 7.

When the fluid pressure increases, the fluid that lies in the hollow of the rod 23 pushes back the ball 29, beyond a pressure threshold (calibrated leak 14) and can flow along the ducts 27 into longitudinal grooves 52 on the periphery of the piston 8. From there, the fluid can, in part, rise up along the spring 17 and, mostly, be pushed toward the top 7A of the core sample 7 and into the gap 28 and beyond, so as to coat and/or lubricate the core sample 7 as it is formed and as it enters the inner barrel 5. Excess fluid from the internal space 6 can mix with the fluid leaving the nozzles 44 and be discharged via this fluid.

Figure 5:
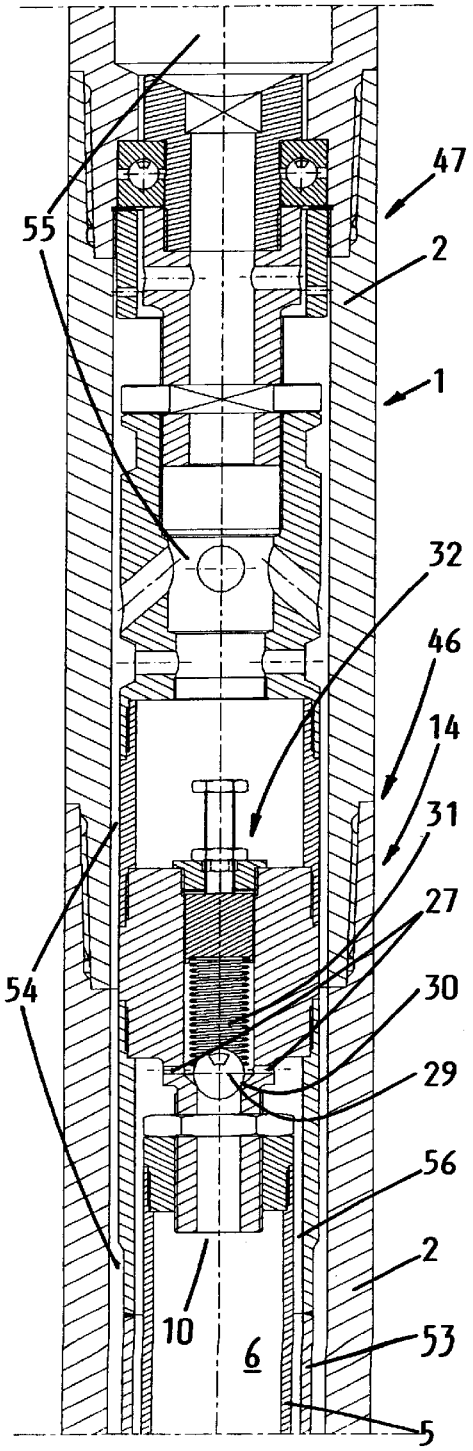
FIG. 5 depicts diagrammatically, in longitudinal section, with cutaway, the core sampler of FIG. 4 at the point where the inner and outer barrels are connected, according to one embodiment.
Figure 6:
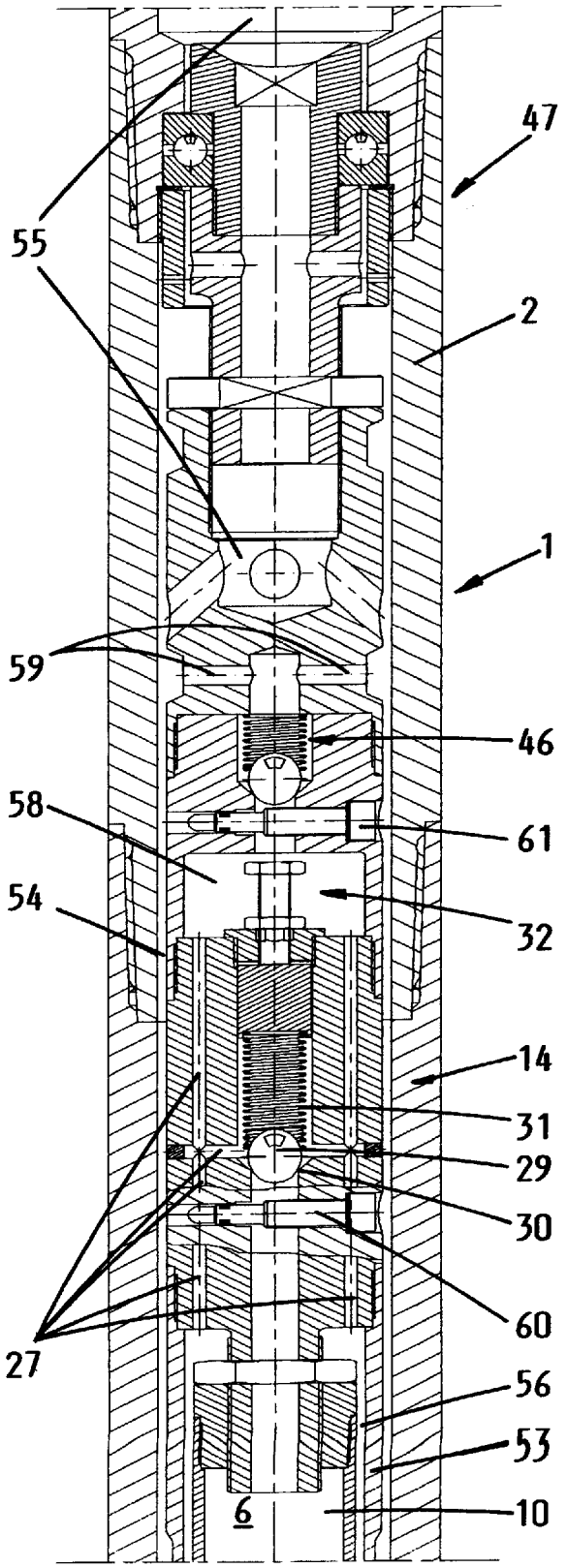
FIG. 6 depicts diagrammatically, in longitudinal section, with cutaway, the core sampler of FIG. 4 at the point where the inner and outer barrels are connected, according to another embodiment.

FIGS. 4 to 6 show another embodiment of the core sampler 1 of the invention. A middle barrel 53, possibly made of several lengths, is arranged coaxially between the outer barrel 2 and the inner barrel 5. A first annular longitudinal channel 54 is then formed by a space between the outer barrel 2 and the middle barrel 53 and it places in sampling-fluid communication the nozzles 44 of the bit 3 and a duct 55 for supplying core-sampling fluid from the reservoir on the surface. A second annular longitudinal channel 56 is formed by a space between the middle barrel 53 and inner barrel 5 and is in fluid communication, for example, via flutes 57, on the one hand, with the closed end 10 of the inner barrel 5 and, on the other hand, (at the front end 4) with the periphery of the core sample 7 close to the outlet 57A of the flutes 57.

The configuration of FIGS. 4 to 6 has, over the configuration of the preceding figures, the advantage that the sampling fluid which has to escape from the internal space 6 cannot be prevented from doing so by an obstruction of the annular space 28 between the core sample 7 and the inner barrel 5, unlike what could occur in the embodiment of FIG. 1.

In the configuration of FIGS. 4 to 6, the leak-adjustment means 14 are arranged in said fluid communication between the closed end 10 and the second longitudinal channel 56. The piston 8 can therefore be simplified and comprise just the means of introducing fluid 9. In addition, in the case of FIG. 5, the leak-adjusting means 14 may also act as a safety valve 46 with leakage via the same longitudinal channel 56.

The embodiment of FIG. 6 differs from that of FIG. 5 in that the safety valve 46 is separate from the leak-adjusting means 14. In the case of FIG. 6, the channels 27 also communicate with a chamber 58 and, from there, via the safety valve 46 (thus situated downstream of the leak-adjusting means 14 for fluid leaving the internal space 6), with one or more radial ducts 59 in fluid communication with the longitudinal channel 54. In this case, if an obstruction prevents fluid from leaving the second longitudinal channel 56 at the front end 4, this fluid can escape, via the safety valve 46, through the first longitudinal channel 54 and through the nozzles 44, with the sampling fluid from the supply duct 55.

In communication with the closed end 10 (FIGS. 3 and 6) there may be a means 60 of dumping pressure to the atmosphere, for example in the form of a bleed screw 60 designed to be actuated by an operator when the inner barrel 5 (FIG. 3), or, as appropriate, this barrel and the middle barrel 53 fixed together (as is depicted in FIG. 6) is, or respectively are, withdrawn at least partially from the outer barrel 2 after a core-sampling operation, so that the finished core sample 7 can be extracted therefrom. Thus, a residual pressure of fluid blocked in the internal space 6 between the core sample 7, the closed end 10 and the ball 29 pressed by the spring 31 can be eliminated using this means 60 before the core sample 7 is freed and withdrawn from the internal space.

In the case of FIG. 6, another bleed screw 61 is provided, to allow any fluid pressure that might remain in the chamber 58, the duct 27 and the second longitudinal channel 56 as a result of a blockage thereof to be eliminated before the core sample 7 is withdrawn from the inner barrel 5.

It must be understood that the invention is not in any way restricted to the embodiments described and that many modifications may be made to these without departing from the scope of the present invention.

Thus, it is within the competence of the persons skilled in the art to calculate, as a function of their interactions, the springs to be used and, as a function of the service pressures that exist in a sampling hole and in the sampling fluid sent from the ground, the pressures to be produced in the core sampler 1 of the invention.

In order to grasp at the front end 4 a finished core sample 7, the core sampler 1 of the invention may be fitted with a locking system 62 with a split frustoconical ring known in the art and depicted schematically in FIGS. 1, 2 and 4.

It must be understood that the ducts, channels, passages, pipes, grooves, flutes, etc. mentioned above may have forms other than those given hereinabove by way of example.

List of Reference Numerals

1 core sampler
2 outer barrel
3 coring bit
4 front end (for example of the outer barrel 2)
5 inner barrel
6 internal space
7 core sample
7A top of core sample
8 piston
8A face of piston 8 resting on core sample 7
9 means for introducing a fluid
10 closed end of inner barrel 5
13 elastically compressible means
14 leak-adjustment means
calibrated leak
15 opposite side of piston 8
16 auxiliary piston
17 compressible elastic element
spring
18 annular seal
19 face of auxiliary piston 16
20 face of piston 8
23 coaxial rod
24 stop means
25 annular seal
27 channels
27A axial duct
27B radial ducts
27C annular duct
27D radial ducts
28 annular gap between core sample 7 and bit 3
29 ball
30 valve seat
31 compression spring
32 assembly for adjusting the spring 31
33 cap
34 adjusting shim
38 portion of piston 8
39 front end of piston 8
40 filling port
41 nonreturn spring ball [sic]
42 duct
42A radial duct
42B annular duct
42C longitudinal duct(s)
42D radial duct(s)
43 plugging screw
44 nozzles of bit 3
45 longitudinal pipe
46 safety valve
47 connecting means
48 common longitudinal axis
49 elastic element
52 longitudinal grooves
53 middle barrel
54 first annular longitudinal channel
55 fluid supply duct
56 second annular longitudinal channel
57 flutes
57A flute outlet
58 chamber
59 radial duct
60 pressure dumping means
bleed screw
61 other bleed screw
62 locking system with split frustoconical ring.

What is claimed is:

1. Core-sampling method, comprising:

core sampling using a core sampler (1) comprising at least an inner barrel (5), an outer barrel (2) and a bit (3), characterized in that said method further comprises:

during at least most of the core-sampling, applying, to a top (7A) of a core sample (7) being formed, a substantially axial compression force (F) that is within limits chosen as a function of a material of the core sample (7), and eliminating this force (F), at the latest before the core sample (7) is removed from the inner barrel (5).

2. Core-sampling method according to claim 1, characterized in that the compression force (F) is produced by:

bringing one face (8A) of a piston (8) against the top (7A) of the core sample (7), introducing on the opposite side (15) of the piston a fluid pressure which is brought up to a pressure sufficient to produce the compression force (F), accumulating energy resulting from the pressure of the fluid, and when said fluid pressure decreases, restoring the accumulated energy, in the form of the compression force (F) being maintained, at least temporarily, on the top (7A) of the core sample (7).

3. Core-sampling method according to claim 2, characterized in that:

at the beginning of the core sampling, the fluid introduced into the inner barrel (5) is practically at a pressure of a medium surrounding the bit (3), and as the core sample (7) enters the inner barrel (5), the core sample pushes the piston (8) into the inner barrel, and this piston thus compresses the fluid to a pressure within a range of pressures determined by a calibrated leak (14) of fluid.

4. Core-sampling method according to claim 3, characterized in that at least some of the fluid which escapes through the calibrated leakage (14) is distributed around the core sample (7).

5. Core sampler, comprising:

an outer barrel (2), a coring bit (3) borne by one end of the outer barrel (2), known as the front end when considering the direction of progress of the core sampler (1) during core sampling, an inner barrel (5), housed in the outer barrel (2) and having an internal space (6) for accommodating a core sample (7), a piston (8) arranged in the internal space (6) in order to slide in the internal space and so as to be able to press against the bottom of a sampling hole and on the top (7A) of the core sample (7), which sample is formed and penetrates the inner barrel (5), and means (9) of introducing a fluid into the internal space (6) between the piston (8) and a closed end (10) of the inner barrel (5), situated at the rear end of the inner barrel, characterized in that the core sampler further comprises:

elastically compressible means (13), arranged in connection with the internal space (6) so as to be able to accumulate and restore energy resulting from pressurizing of the fluid introduced, at least following compression of this fluid by the piston (8) driven into the internal space (6) by the core sample (7), and adjusting means (14) for adjusting a leak of the fluid introduced, which adjusting means are arranged in such a way that the fluid introduced into the internal space (6) can escape therefrom as the core sample (7) pushes the piston (8) into the internal space, and so that depending on the leak adjustment, the pressure of the fluid introduced into the internal space (6) increases up to a value sufficient to produce a substantially axial compression force (F) applied by the piston (8) to the top (7A) of the core sample (7) and which force is between limits chosen as a function of a material of the core sample (7).

6. Core sampler according to claim 5, characterized in that:

the elastically compressible means (13) comprise, on the opposite side (15) of the piston (8) to the core sample (7), an auxiliary piston (16) arranged to slide in the internal space (6) and a compressible elastic element (17) arranged between the piston (8) and the auxiliary piston (16), and the auxiliary piston (16) has, on the opposite side of the auxiliary piston, a face (19) which is intended to receive the aforementioned pressure introduced into the internal space and which is dimensioned to provide at least some of the aforementioned force (F).

7. Core sampler according to claim 6, characterized in that:

the piston (8) comprises, on the same side as the closed end (10) of the inner barrel (5), a rod (23) coaxial with this barrel, and the auxiliary piston (16) is annular and is mounted in such a way that it can slide along the coaxial rod (23) toward the piston (8) from a position away from the piston (8) which is determined by stop means (24) situated away from the piston (8) on the coaxial rod (23).

8. Core sampler according to any one of claims 5 to 7, characterized in that the piston (8) comprises means of adjusting the leak (14) and channels (27) associated with these means of adjusting the leak and designed to place the internal space (6) in communication with the top (7A) of the core sample (7) and, from there, with an annular gap (28) between the core sample (7) being formed and the inner barrel (5), via the leakage-adjustment means (14).

9. Core sampler according to any one of claims 5 to 7, characterized in that the core sampler comprises:

a middle barrel (53) arranged coaxially between the outer barrel (2) and the inner barrel (5).

a first annular longitudinal channel (54) which is formed by a space between the outer barrel (2) and the middle barrel (53) and which places nozzles (44) of the bit (3) in communication with a duct (55) for supplying core-sampling fluid from a reservoir on the surface, a second annular longitudinal channel (56) which is formed by a space between the middle barrel (53) and the inner barrel (5) and which is in fluid communication, on the one hand, with the closed end (10) of the inner barrel (5) and, on the other hand, with the periphery of the core sample (7) in the bit (3).

10. Core sampler according to any one of claims 5 to 7, characterized in that the piston (8) comprises, at that point on its end (39) that is intended to interact with the top (7A) of the core sample (7), a filling port (40) and, connected to this filling port, a duct (42) through the piston (8), so that a fluid can be injected, via the port (40) and the duct (42), at least into part of the internal space (6) prior to core sampling when the piston (8) is practically at the point of the front end (4) of the internal space (6).

11. Core sampler according to any one of claims 5 to 7, characterized in that the fluid introduced into the internal space (6) is different from the core-sampling fluid.

12. Core sampler according to any one of claims 5 to 7, characterized in that the core sampler comprises, at the closed end of the internal space (6), a safety valve (46) which is designed to open in order to bleed air out of the internal space (6) when the internal space is being filled and which, when the safety valve is open, places the internal space (6) in communication with an annular space for the fluid between the outer barrel (2) and inner barrel (5).

13. Core sampler according to any one of claims 5 to 7, characterized in that the core sampler comprises, in communication with the closed end (10) of the internal space (6), a means (60) of dumping pressure from the core sampler, this means being designed to be actuated when the inner barrel (5) is withdrawn at least partially from the outer barrel (2) after a core-sampling operation.

* * * * *